US009136618B2

(12) United States Patent
Tsai

(10) Patent No.: US 9,136,618 B2
(45) Date of Patent: Sep. 15, 2015

(54) ALLIGATOR CLIP

(71) Applicant: Shou-Chun Tsai, Taichung (TW)

(72) Inventor: Shou-Chun Tsai, Taichung (TW)

( * ) Notice: Subject to any disclaimer, the term of this patent is extended or adjusted under 35 U.S.C. 154(b) by 107 days.

(21) Appl. No.: 14/016,575

(22) Filed: Sep. 3, 2013

(65) Prior Publication Data

US 2015/0064990 A1 Mar. 5, 2015

(51) Int. Cl.
*H01R 11/24* (2006.01)

(52) U.S. Cl.
CPC ..... *H01R 11/24* (2013.01)

(58) Field of Classification Search
CPC ..... H01R 11/24
USPC ..... 439/759, 822, 829, 509, 729
See application file for complete search history.

(56) References Cited

U.S. PATENT DOCUMENTS

| | | | | |
|---|---|---|---|---|
| 3,374,455 | A * | 3/1968 | Sullivan et al. | 439/219 |
| 4,565,001 | A * | 1/1986 | Patton | 29/866 |
| 6,623,314 | B1 * | 9/2003 | Cox et al. | 439/759 |
| 2002/0144381 | A1 * | 10/2002 | Olivares et al. | 24/499 |

* cited by examiner

*Primary Examiner* — Abdullah Riyami
*Assistant Examiner* — Nelson R Burgos-Guntin
(74) *Attorney, Agent, or Firm* — Hershkovitz & Associates, PLLC; Abe Hershkovitz

(57) ABSTRACT

An alligator clip has an operating clipping body, a connection clipping body, a pivot and a resilient member. The operating clipping body has a clipping segment and an operating segment. The connection clipping body is pivotally connected with the operating clipping body by the pivot and has a clipping segment, an operating segment and a wire connection segment. The clipping segment corresponds to the clipping segment of the operating clipping body in position. The operating segment corresponds to the operating segment of the operating clipping body in position. The wire connection segment is connected with the operating segment of the connection clipping body and has two squeezing tabs and at least one conducting claw being jagged. The resilient member is mounted around the pivot and between the operating clipping body and the connection clipping body.

13 Claims, 4 Drawing Sheets

ALLIGATOR CLIP

BACKGROUND OF THE INVENTION

1. Field of the Invention

The present invention relates to a clip, and more particularly to an alligator clip that can be connected with an electric wire easily and conveniently.

2. Description of Related Art

An alligator clip is made of metal, can clip an electrical terminal and be connected with an electric wire to form a connection for electrical power or electronic signal and is widely used in electronics industry, electrical engineering or vehicle engineering.

With reference to FIG. 4, a conventional alligator clip 90 is connected with an electric wire 50 and comprises upper clipping body 91, a lower clipping body 92, a pivot 93, a resilient member 94 and a connection assembly 95. The lower clipping body 92 is pivotally connected with the upper clipping body 91 by the pivot 93, such that a clipping segment and an operating segment are formed respectively on two ends of each clipping body 91,92. The resilient member 94 is mounted around the pivot 93 to provide a force such that the clipping segments of the clipping bodies 91,92 can clamp with each other. The lower clipping body 92 further has a through hole and a wire connection segment 921. The connection assembly 95 comprises a wire-connection terminal 951, a bolt 952 and a nut 953. The wire-connection terminal 951 comprises a clamping segment to clamp a leading wire 51 of the electric wire 50 and a through hole. The bolt 952 is mounted through the through holes in the wire-connection terminal 951 and the lower clipping body 92 and is screwed with the nut 953. The wire connection segment 921 is then bent to clamp the electric wire 50, such that the electric wire 50 is securely connected with the alligator clip 90.

However, to connect the electric wire 50 with the alligator clip 90 is complicated and laborious, and the wire-connection terminal 951, the bolt 952 and the nut 953 have to be previously prepared. The process of connecting an electric wire 50 with the conventional alligator clip 90 at least comprises a) clamping the electric wire 50 on the clamping segment of the wire-connection terminal 951; b) screwing the bolt 952 with the nut 953; and c) clamping the electric wire 50 by bending the wire connection segment 921 on the lower clipping body 92. Therefore, the conventional alligator clip 90 has a complicated structure and is laborious in connection with the electric wire 50.

To overcome the shortcomings, the present invention tends to provide an alligator clip to mitigate or obviate the aforementioned problems.

SUMMARY OF THE INVENTION

The main objective of the invention is to provide an alligator clip that has a simplified structure and can be connected with an electric wire easily and conveniently.

The alligator clip has an operating clipping body, a connection clipping body, a pivot and a resilient member. The operating clipping body has a clipping segment and an operating segment. The connection clipping body is pivotally connected with the operating clipping body by the pivot and has a clipping segment, an operating segment and a wire connection segment. The clipping segment corresponds to the clipping segment of the operating clipping body in position. The operating segment corresponds to the operating segment of the operating clipping body in position. The wire connection segment is connected with the operating segment of the connection clipping body and has two squeezing tabs and at least one conducting claw being jagged. The resilient member is mounted around the pivot and between the operating clipping body and the connection clipping body.

Other objects, advantages and novel features of the invention will become more apparent from the following detailed description when taken in conjunction with the accompanying drawings.

DETAILED DESCRIPTION OF PREFERRED EMBODIMENT

Figure 1:
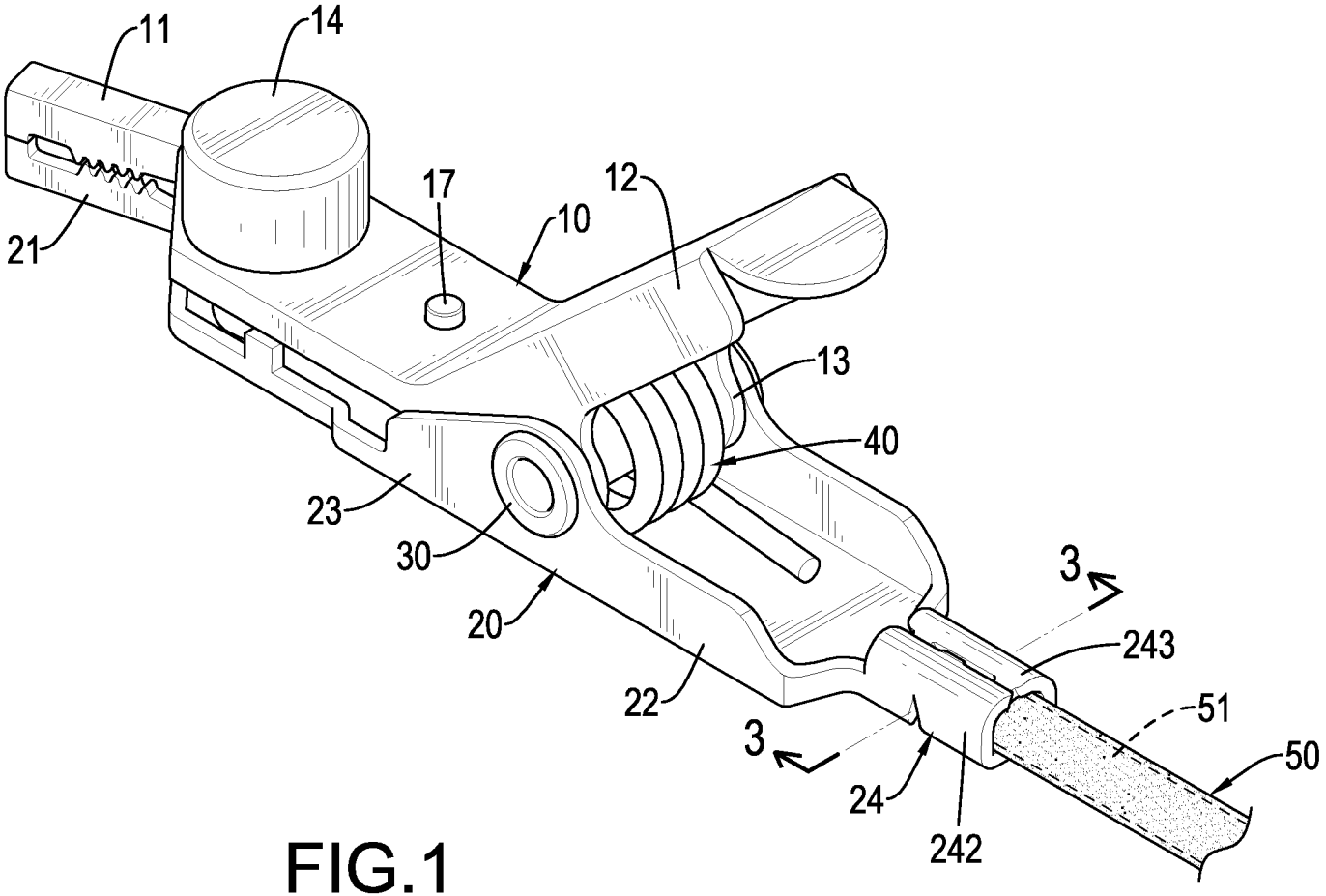
FIG. 1 is a perspective view of an alligator clip in accordance with the present invention.
Figure 2:
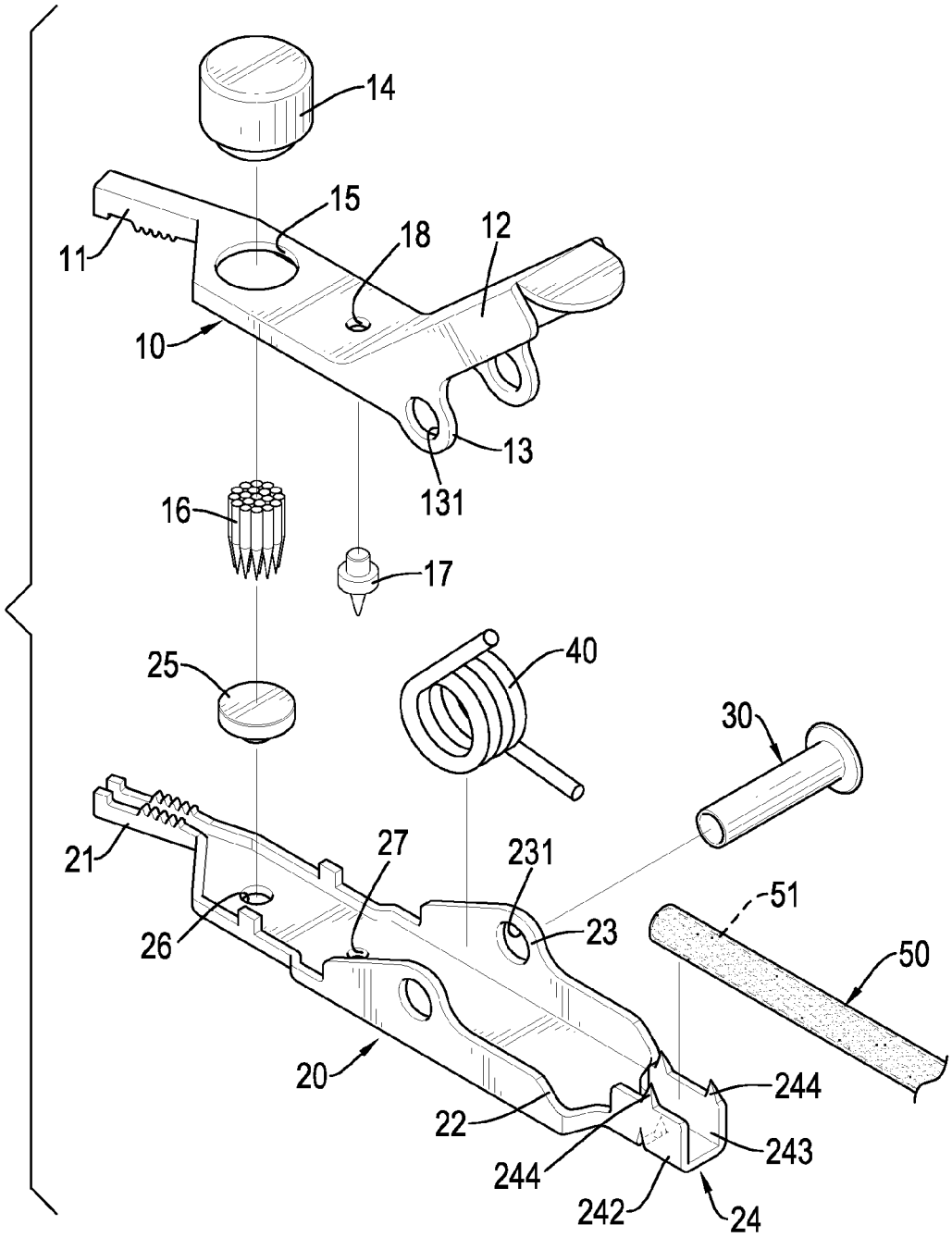
FIG. 2 is an exploded perspective view of the alligator clip in FIG. 1.
Figure 3:
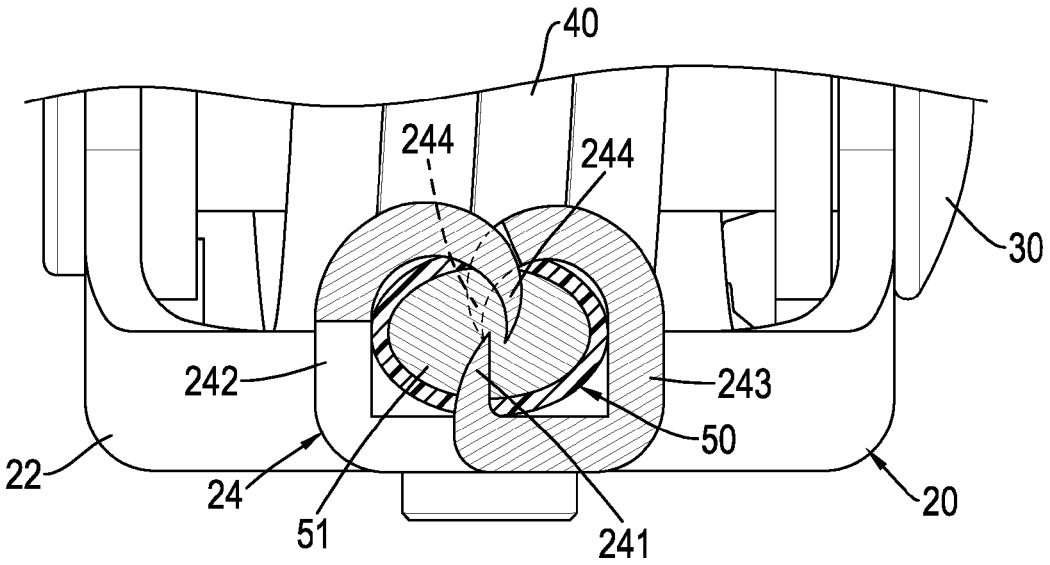
FIG. 3 is an enlarged cross sectional rear view of the alligator clip in FIG. 1.
Figure 4:
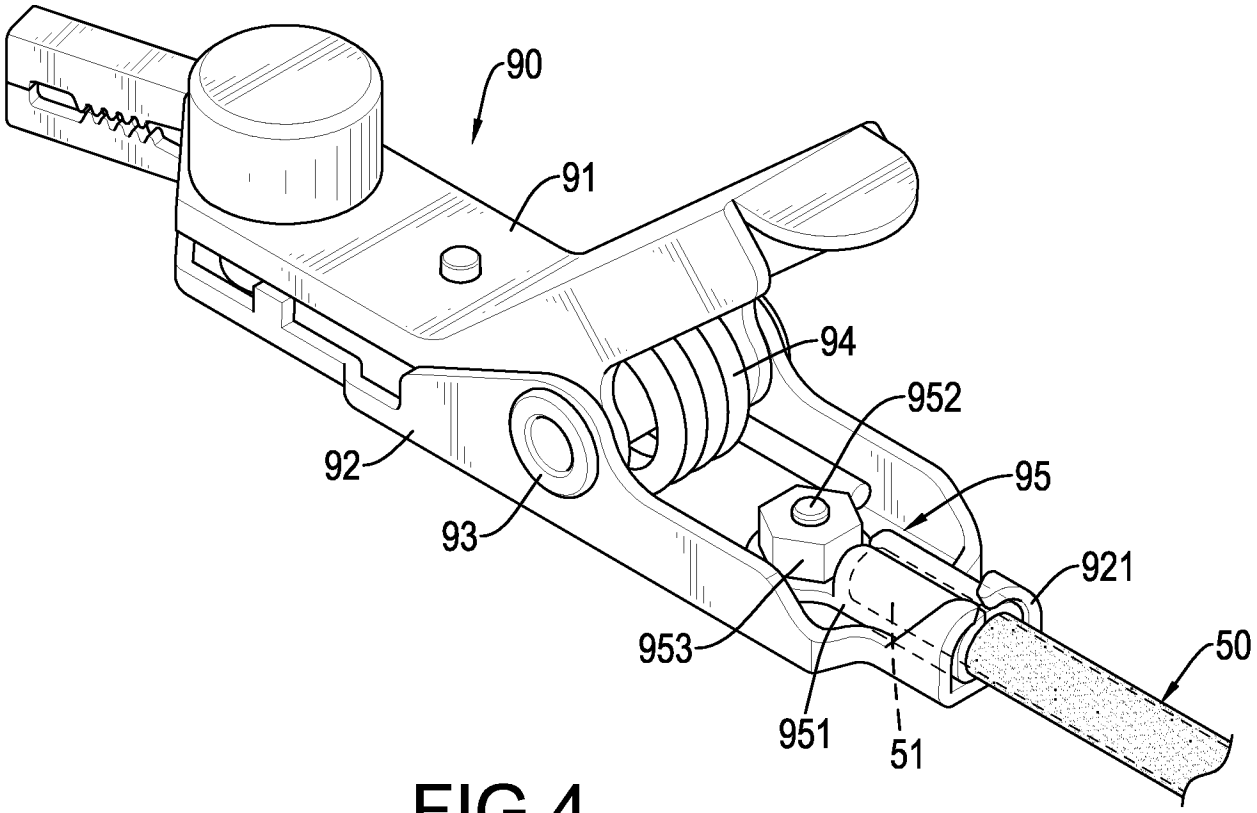
FIG.4 PRIOR ART
FIG. 4 is a perspective view of a conventional alligator clip in accordance with the prior art.

With reference to FIGS. 1 to 3, an alligator clip in accordance with the present invention comprises an operating clipping body 10, a connection clipping body 20, a pivot 30 and a resilient member 40.

The operating clipping body 10 and the connection clipping body 20 are pivotally connected with each other by the pivot 30, such that a clipping segment 11,21 and an operating segment 12,22 are formed respectively on two ends of each clipping body 10,20. The clipping segments 11,21 of the clipping bodies 10,20 are jagged. The resilient member 40 is mounted around the pivot 30 and between the operating clipping body 10 and the connection clipping body 20 and provides a force to make the clipping segments 11,21 of the clipping bodies 10,20 clamp with each other. In a preferable embodiment, the resilient member 40 is a torsion spring.

With reference to FIGS. 1 and 2, the operating clipping body 10 is made of a metal sheet by a pressing process and further has two pivotal ears 13, a mounting hole 15, a pin mount 14, multiple conductive pins 16, a pin hole 18 and a positioning pin 17. The pivotal ears 13 are formed respectively on the middles of two side walls of the operating clipping body 10, and each pivotal ear 13 has a pivotal hole 131. The mounting hole 15 is defined in the clipping segment 11 of the operating clipping body 10. The pin mount 14 is metal and is mounted securely in the mounting hole 15. The conductive pins 16 are mounted on the pin mount 14 and extend toward the connection clipping body 20. The pin hole 18 is defined in the clipping segment 11, and the positioning pin 17 is mounted in the pin hole 18 and has a tip end extending toward the connection clipping body 20.

With reference to FIGS. 2 and 3, the connection clipping body 20 is adapted to connect with an electric wire 50, is formed of a metal sheet with a pressing process and corresponds to the operating clipping body 10 in shape. The connection clipping body 20 further has two pivotal ears 23, a wire connection segment 24, a pad hole 26, a pad 25 and a positioning hole 27. The pivotal ears 23 are formed respectively on the middles of two side walls of the connection clipping body 20, and each pivotal ear 23 has a pivotal hole 231. The wire connection segment 24 is integrally formed on and extends from the operating segment 22 of the connection clipping body 20. The pad hole 26 is defined in the clipping segment 21 of the connection clipping body 20. The pad 25 is metal, is mounted in the pad hole 26 and selectively abuts with the conductive pins 16 on the operating clipping body 10. The positioning hole 27 is defined in the clipping segment 21 of the connection clipping body 20 and is selectively mounted through by the positioning pin 17.

The wire connection segment 24 is made of a metal sheet by a pressing process and has a first conducting claw 241, two squeezing tabs 242,243 and three second conducting claws 244. The first conducting claw 241 is jagged, is formed by cutting and bending the metal sheet which forms the wire connection segment 24 and is formed on a middle segment of the wire connection segment 24. The squeezing tabs 242,243 are formed by bending the metal sheet which forms the wire connection segment 24. Before the squeezing tabs 242,243 are bent to clamp an electric wire 50, the squeezing tabs 242,243 are substantially parallel with each other. The second conducting claws 244 are jagged and are respectively formed on the squeezing tabs 242,243 in an alternative form in position. Preferably, two of the second conducting claws 244 are formed on one of the squeezing tabs 243 and the other one of the second conducting claws 244 is formed on the other squeezing tab 242. Alternatively, at least one second conducting claw 244 is formed on each squeezing tab 242,243. For example, two second conducting claws 244 are formed on each squeezing tab 242,243, or a single conducting claw 244 is formed on a middle of each squeezing tab 242,243. The number and position of the second conducting claws 244 are not limited in the present invention.

With reference to FIGS. 1 to 3, the pivot 30 is mounted through the pivotal holes 131,231 in the pivotal ears 13,23 on the clipping bodies 10,20 to pivotally connect the clipping bodies 10,20 with each other.

To connect the alligator clip with an electric wire 50, an end of the electric wire 50 is put into the wire connection segment 24 and the first conducting claw 241 pierces through the coat of the electric wire 50 and into the leading wire 51. In an alternative embodiment, the coat of the electric wire 50 on the end can be previously removed to expose the end of the leading wire 51 for connecting with the first conducting claw 241. Then, the squeezing tabs 242,243 are bent by tools or machines to clamp the end of the electric wire 50, such that the second conducting claws 244 pierce through the coat of the electric wire 50 and into the leading wire 51. With conducting claws 241,244 piercing into the leading wire 51, the alligator clip is electrically and securely connected with the electric wire 50. Accordingly, the alligator clip in accordance with the present invention has a simplified structure and can be connected with an electric wire 50 easily and conveniently. The cost for manufacturing and connecting the alligator clip with an electric wire 50 can be reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An alligator clip comprising:

an operating clipping body having a clipping segment and an operating segment;

a connection clipping body pivotally connected with the operating clipping body by a pivot and having a clipping segment, wherein the clipping segment of the connection clipping body corresponds to the clipping segment of the operating clipping body in position;

an operating segment, wherein the operating segment of the connection clipping body corresponds to the operating segment of the operating clipping body in position; and a wire connection segment connected with the operating segment of the connection clipping body and having two squeezing tabs and at least one conducting claw being jagged; and a resilient member mounted around the pivot and between the operating clipping body and the connection clipping body, wherein the operating clipping body further comprises:

a pin mount being metal and mounted on the operating clipping body; and multiple conductive pins mounted on the pin mount and extending toward the connection clipping body.

2. The alligator clip as claimed in claim 1, wherein the operating clipping body and the connection clipping body are formed of metal sheets with pressing processes and correspond to each other in shape; and the wire connection segment is integrally formed on and extends from the operating segment of the connection clipping body.

3. The alligator clip according to claim 1, wherein the connection clipping body further comprises a metal pad mounted on the connection clipping body and selectively abutting the conductive pins on the operating clipping body.

4. The alligator clip as claimed in claim 3, wherein the operating clipping body further has a positioning pin mounted on the operating clipping body and having a tip end extending toward the connection clipping body; and the connection clipping body further has a positioning hole defined in the clipping segment of the connection clipping body and selectively mounted through by the positioning pin.

5. The alligator clip as claimed in claim 4, wherein the at least one conducting claw includes a first conducting claw formed on a middle segment of the wire connection segment.

6. The alligator clip as claimed in claim 5, wherein the at least one conducting claw includes multiple second conducting claws that are respectively formed on the squeezing tabs.

7. The alligator clip as claimed in claim 6, wherein the second conducting claws on the squeezing tabs are arranged in an alternate form in position.

8. The alligator clip as claimed in claim 7, wherein the second conducting claws are implemented as three in amount; and two of the second conducting claws are formed on one of the squeezing tabs and the other one of the second conducting claws is formed on the other squeezing tab.

9. The alligator clip as claimed in claim 1, wherein the at least one conducting claw includes a first conducting claw formed on a middle segment of the wire connection segment.

10. The alligator clip as claimed in claim 9, wherein the at least one conducting claw includes multiple second conducting claws that are respectively formed on the squeezing tabs.

11. The alligator clip as claimed in claim 10, wherein the second conducting claws on the squeezing tabs are arranged in an alternate form in position.

12. The alligator clip as claimed in claim 11, wherein the second conducting claws are implemented as three in amount; and two of the second conducting claws are formed on one of the squeezing tabs and the other one of the second conducting claws is formed on the other squeezing tab.

13. The alligator clip as claimed in claim 1, wherein the at least one conducting claw includes multiple conducting claws that are respectively formed on the squeezing tabs.

* * * * *